US006735785B2

(12) United States Patent
Takayama

(10) Patent No.: US 6,735,785 B2
(45) Date of Patent: May 18, 2004

(54) CLOTHING WAIST PORTION STRUCTURE

(76) Inventor: Kohji Takayama, 1-2-51-B811, Hanatennishi, Jyoto-Ku, Osaka (JP)

( * ) Notice: Subject to any disclaimer, the term of this patent is extended or adjusted under 35 U.S.C. 154(b) by 0 days.

(21) Appl. No.: 10/092,762

(22) Filed: Mar. 7, 2002

(65) Prior Publication Data

US 2002/0092084 A1 Jul. 18, 2002

(51) Int. Cl.[7] ..... A41F 9/00
(52) U.S. Cl. ..... 2/236
(58) Field of Search ..... 2/236, 220, 221, 2/222, 223, 235, 237, 94, 92, 76, 214, 215, 219

(56) References Cited

U.S. PATENT DOCUMENTS 1,478,521 A * 12/1923 Kershner
1,929,296 A * 10/1933 Warren ..... 2/236
2,667,643 A * 2/1954 Elman ..... 2/236
2,718,011 A * 9/1955 Caruso ..... 2/236
3,427,661 A * 2/1969 Navasky ..... 2/236
3,732,576 A * 5/1973 Gauthier ..... 2/221
3,757,354 A * 9/1973 Moody ..... 2/224 R
4,332,034 A * 6/1982 Muse ..... 2/237
4,890,337 A * 1/1990 Greenberg ..... 2/236
4,970,728 A * 11/1990 D'Ambrosio ..... 2/237
5,090,060 A * 2/1992 Gates ..... 2/115
5,675,842 A * 10/1997 Schaefer ..... 2/237
5,735,145 A * 4/1998 Pernick ..... 66/196
5,867,836 A * 2/1999 Quinones ..... 2/236
5,887,284 A * 3/1999 Simmons ..... 2/181.4
6,155,083 A * 12/2000 Goeser et al. ..... 66/170
6,237,160 B1 * 5/2001 Bouville ..... 2/311
6,311,333 B1 * 11/2001 Batra ..... 2/237
6,367,086 B1 * 4/2002 Woodard ..... 2/237
6,454,747 B1 * 9/2002 Shimada et al. ..... 604/312

* cited by examiner

*Primary Examiner*—John J. Calvert
*Assistant Examiner*—Alissa L. Hoey
(74) *Attorney, Agent, or Firm*—Darby & Darby

(57) ABSTRACT

A band-shaped upper waist outer cloth is sews to a band-shaped upper inner waist cloth and a lower waist inner cloth is sewn to a band-shaped lower waist outer cloth. A lower portion of the upper cloths are sewn to an upper portion of the lower cloths to form a waist band portion. A lower portion of this waist band portion is sewn to the article of clothing, such as slacks, jeans, skirts, winter wear, underwear, and the like. The material used for the waist band portion is chosen to be sweat-absorbing, quick drying, and warm. The resulting waist band portion absorbs a wearer's sweat, keeping the wearer dry and warm, even in a cold environment.

6 Claims, 4 Drawing Sheets

CLOTHING WAIST PORTION STRUCTURE

BACKGROUND OF THE INVENTION

The present invention relates to the structure of a waist portion in clothing such as pants, slacks, jeans, skirts, underwear or the like.

Conventional pants, slacks, jeans, skirts or the like are made so as to bend respective band portions or to correspond to each wearer's waist shape to give a nice outer appearance. However, no particular consideration of the structure of the waist portion has been given significant attention.

In the conventional waist structures, for example, some sweat may adhere to the waist portion during physical movement or exercise and the waist portion may be cooled in a cold surrounding. Under such circumstances, people have felt that the waist portion in pants, slacks, skirts or the like is not satisfactory and must be improved in order to keep better health.

OBJECTS AND SUMMARY OF THE INVENTION

It is an object of the present invention to provide a waist portion structure for clothing which solves the above-described problems Accordingly, it is an object of the present invention to provide a waist portion structure in clothing which is capable of absorbing sweat adhered to the waist portion during a wearer's physical movement or exercise, promptly making dry any wet portions made by the sweat, thus keeping the waist portion warm in a cold surrounding.

Briefly stated, the present invention provides a band-shaped upper waist outer cloth sewn to a band-shaped upper inner waist cloth and a lower waist inner cloth sewn to a lower waist outer cloth. A lower portion of the upper cloths are sewn to an upper portion of the lower cloths to form a waist band portion. The material used for the inner cloth of the waist band portion is chosen to be sweat-absorbing, quick drying, and warm. The resulting waist band portion absorbs a wearer's sweat, keeping the wearer dry and warm, even in a cold environment.

According to a first aspect of the present invention, a waist portion structure for clothing includes a band-shaped upper waist outer cloth; a lower waist outer cloth, separated and extending downwardly from the band-shaped upper waist outer cloth; a band-shaped upper waist inner cloth fixed to the upper waist outer cloth; and a band-shaped lower waist inner cloth fixed to the upper waist outer cloth; wherein the upper waist outer and inner cloths are fixed to the lower waist inner and outer cloths; and each of the upper waist inner cloth and the lower waist inner cloth are made of a sweat-absorbing material having speedy drying and warmth keeping properties According to a second aspect of the present invention, in a waist portion structure for clothing, the lower waist outer cloth is separated from a clothing body and is fixed to the lower waist inner cloth.

According to a third aspect of the present invention, in a waist portion structure for clothing, the lower waist inner cloth is at least bent downwardly and widened laterally in the vicinity of a waist center.

According to a fourth aspect of the present invention, in a waist portion structure for clothing, the upper waist outer cloth and the upper waist inner cloth are bent upwardly in the vicinity of a waist center, while the lower waist outer cloth and the waist inner cloth are bent downwardly and widened laterally in the vicinity of the waist center.

According to a fifth aspect of the present invention, in a waist portion structure for clothing, the lower waist outer cloth is replaced with an outer cloth of the clothing and an upper end of the lower waist inner cloth is fixed to an lower end of the upper waist inner cloth and the upper waist outer cloth.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Hereinafter, one embodiment of the present invention will be described with reference to FIGS. 1 to 4.

Figure 1:
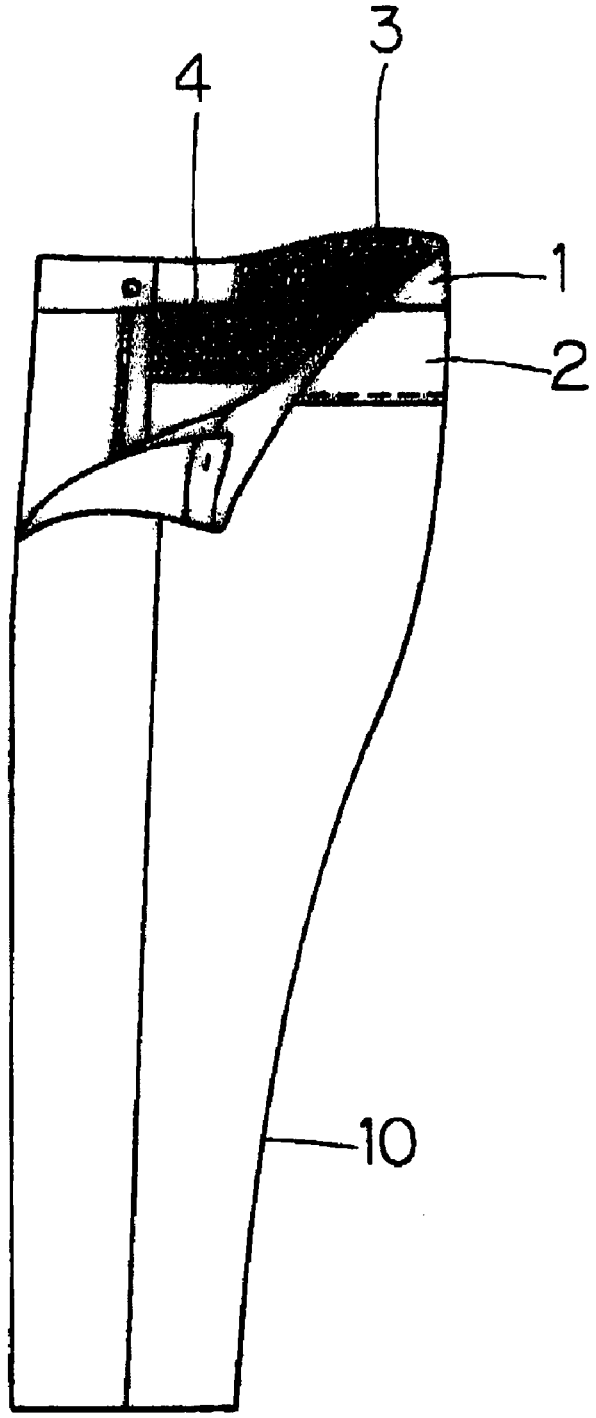
FIG. 1 is a view of a structure of a waist portion in slacks according to the present invention.
Figure 2:
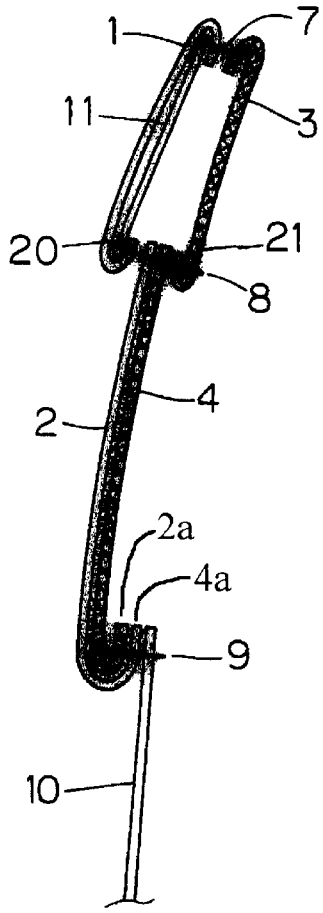
FIG. 2 is a sectional view of a first embodiment of a structure of a waist portion in FIG. 1.

Referring to FIGS. 1 and 2, a slacks body 10 has a band-shaped upper waist outer cloth 1 and a band-shaped lower waist outer cloth 2, extending downwardly and separated from each other. Upper waist outer cloth 1 and lower waist outer cloth 2 are later fixed to each other. Upper waist outer cloth 1 is sewn to a band-shaped upper inner waist cloth 3, while lower waist outer cloth 2 is sewn to a band-shaped lower waist inner cloth 4. Inner cloths 3 and 4 are made of a sweat-absorbing, speedy drying and warmth keeping material.

A top end of upper waist outer cloth 1, holding a core material 11, along with a top end of upper waist inner cloth 3 are bent inwardly and then sewn to each other. Further, a lower end 20 of waist outer cloth 1 and a lower end 21 of waist inner cloth 3 are also bent inwardly, thereby forming a sewing portion. Both top ends of lower waist outer cloth 2 and lower waist inner cloth 4 are sewn at sewing portion 8 to both ends 20 and 21. Both lower ends 2*a* and 4*a* of lower waist outer cloth 2 and lower waist inner cloth 4 are bent inwardly and sewn to an upper end 9 of slacks body 10.

The present invention may be applied not only for slacks, but also for various kinds of pants such as jeans, skirts, winter wear, underwear or the like.

Figure 3:
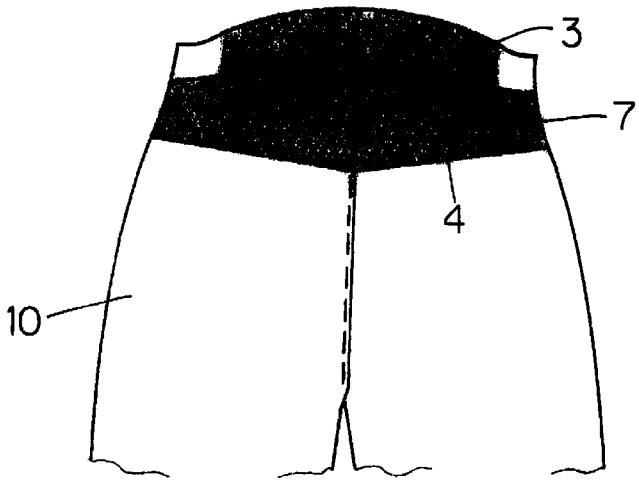
FIG. 3 is a view seen from the interior of the slacks according to the first embodiment of the present invention.

Referring now to FIG. 3, upper waist outer cloth 1 and upper waist inner cloth 3 are bent slightly in the vicinity of a center part of the waist, while lower waist outer cloth 2 and lower waist inner cloth 4, which are laid one upon another, are bent and widened downwardly in the vicinity of the center of the waist so as to be able to receive any shoulder bag such as a knapsack.

Figure 4:
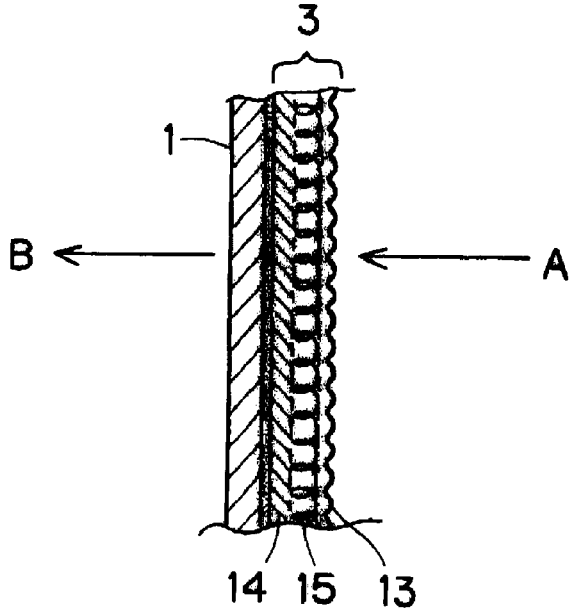
FIG. 4 is a partially enlarged sectional view of a structure of a waist portion according to the present invention.

Referring to FIG. 4, upper waist inner cloth 3, and lower waist inner cloth 4, includes a net-woven material 13, an air-passing loop-shaped cloth 15 and a knitted material 14. Accordingly, a user's sweat is absorbed at (A) section and its moisture is discharged through the two upper cloths 1 and 3 in a direction of arrow (B).

Figure 5:
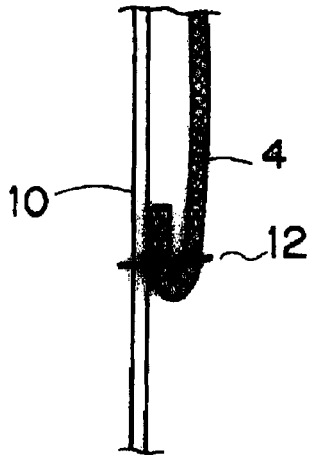
FIG. 5 is a section view of a second embodiment of a structure of a waist portion according to the present invention.

Referring to FIG. 5, there is shown a second embodiment of the present invention, in which slacks body 10 constitutes lower waist outer cloth 2. Lower waist inner cloth 4 is bent and widened downwardly, and sewn to slacks body 10 at a sewing section 12. The remaining part of the second embodiment is identical with the first embodiment.

Figure 6:
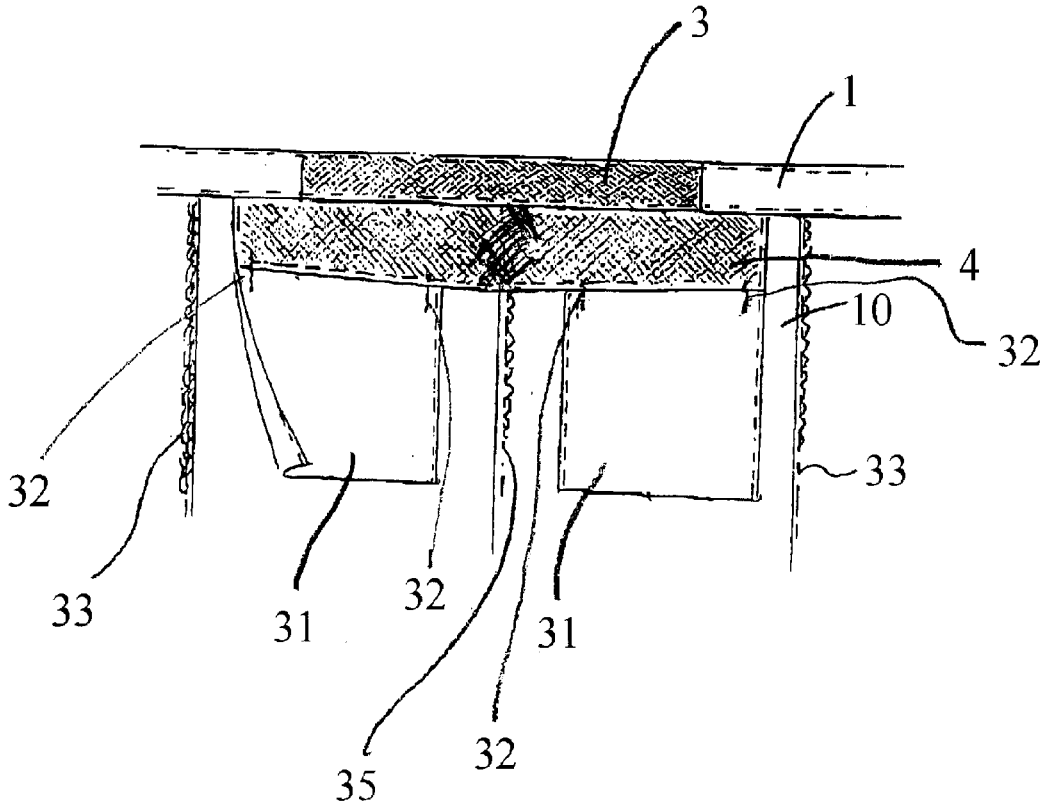
FIG. 6 is a view of a third embodiment of a structure of a waist portion according to the present invention.

FIG. 6 shows a third embodiment of the present invention, in which slacks body 10 constitutes lower waist outer cloth 2 just like in the above second embodiment. Upper waist outer cloth 1 and upper waist inner cloth 3 are sewn to each other at their upper and lower ends. The upper end of lower waist inner cloth 4 is sewn to the lower end of outer and inner cloths 1 and 3 respectively. A pair of pockets 31, 31 are fixed, at their upper side ends 32, 32, to a lower side end of lower waist inner cloth 4. In a skirt having no back pocket, lower waist inner cloth 4 may be sewn to two sides 33, 33 of slacks body 10. Numeral 35 denotes a buttock center line. As in the first and second embodiments, lower waist inner cloth 4 is widened laterally in the vicinity of the waist portion.

As described above, the present invention is able to wipe away smoothly the sweat adhered to the waist portion during physical movement or exercise under a high temperature and high humidity. Further, the present invention is able to keep the waist portion warmer in a cold surrounding. Still further, since the upper waist cloth and the lower waist cloth are bent and widened in the vicinity of the waist portion so as to correspond to the waist shape so that a wearer may feel comfortable during his or her physical movement.

While there has been described what are at present considered to be preferred embodiments of the invention, it will be understood that various modifications may be made thereto, and it is intended that the appended claims cover all such modification as fall within the true spirit and scope of the invention.

What is claimed is:

1. A waist portion structure in clothing, comprising:

an upper waist outer cloth;

a lower waist outer cloth, separated and extended downwardly from said upper waist outer cloth;

an upper waist inner cloth fixed to said upper waist outer cloth;

a lower waist inner cloth fixed to said lower waist outer cloth;

said upper waist outer and inner cloths being fixed to said lower waist inner and outer cloths; and each of said upper waist inner cloth and said lower waist inner cloth being made of a material having sweat-absorbing, speedy drying and warmth keeping properties wherein said material comprises layers of a net-woven material, an air passing loop-shaped cloth, and a knitted material.

2. The waist portion structure in clothing according to claim 1, wherein said upper waist outer cloth, said lower waist inner cloth, said upper waist inner cloth and said lower waist inner cloth are each band-shaped.

3. The waist portion structure in clothing according to claim 1, wherein said lower waist outer cloth is separated from a clothing body and is fixed to said lower waist inner cloth.

4. The waist portion structure in clothing according to claim 1, wherein said lower waist inner cloth is at least curved downwardly and widened laterally in the vicinity of a waist center.

5. The waist portion structure in clothing according to claim 1, wherein:

said upper waist outer cloth and said upper waist inner cloth are curved upwardly in the vicinity of a waist center; and said lower waist outer cloth and said lower waist inner cloth are curved downwardly and widened laterally in the vicinity of said waist center.

6. The waist portion structure in clothing according to claim 1, wherein:

said lower waist outer cloth is replaced with a clothing body; and an upper end of said lower waist inner cloth is fixed to lower ends of said upper waist outer cloth and said upper waist inner cloth.

* * * * *